United States Patent [19]

Bienaime

[11] Patent Number: 5,004,147

[45] Date of Patent: Apr. 2, 1991

[54] PACK MADE FROM BOARD

[75] Inventor: Patrick Bienaime, Troissereux, France

[73] Assignee: Unilever Patent Holdings B.Y., Rotterdam, Netherlands

[21] Appl. No.: 410,625

[22] Filed: Sep. 21, 1989

[30] Foreign Application Priority Data

Oct. 27, 1988 [FR] France ..... 88 14032

[51] Int. Cl.[5] ..... B65D 5/42

[52] U.S. Cl. ..... 229/198.2; 206/140; 229/40

[58] Field of Search ..... 229/40, 185, 198.2; 206/140, 427, 434

[56] References Cited

U.S. PATENT DOCUMENTS

| | | | |
|---|---|---|---|
| 2,990,997 | 7/1961 | Weiss | 229/40 |
| 3,223,308 | 12/1965 | Weiss | 229/40 |
| 3,351,263 | 11/1967 | Wood | 206/140 |
| 3,375,968 | 4/1968 | Weiss | 229/40 |
| 3,432,029 | 3/1969 | Brown | 206/140 |
| 3,705,681 | 12/1972 | Rossi et al. | 229/40 |
| 4,708,284 | 11/1987 | Sutherland et al. | 229/40 |
| 4,723,699 | 2/1988 | Brown et al. | 229/40 |

*Primary Examiner*—Gary E. Elkins

*Attorney, Agent, or Firm*—Cushman, Darby & Cushman

[57] ABSTRACT

Pack made from board for packaging one or more objects, with a blank (100) that has a top panel (110), to which two side panels (120, 130) are hinged, and a base panel consisting of two sections (140*a,b*). One of the base panel sections has tabs (200), while the other one has openings (220, 240) provided to accommodate these tabs. The tab is hinged to the base panel section and can be divided up along a folding line (206), which facilitates insertion in the openings.

10 Claims, 5 Drawing Sheets

Figure 1:
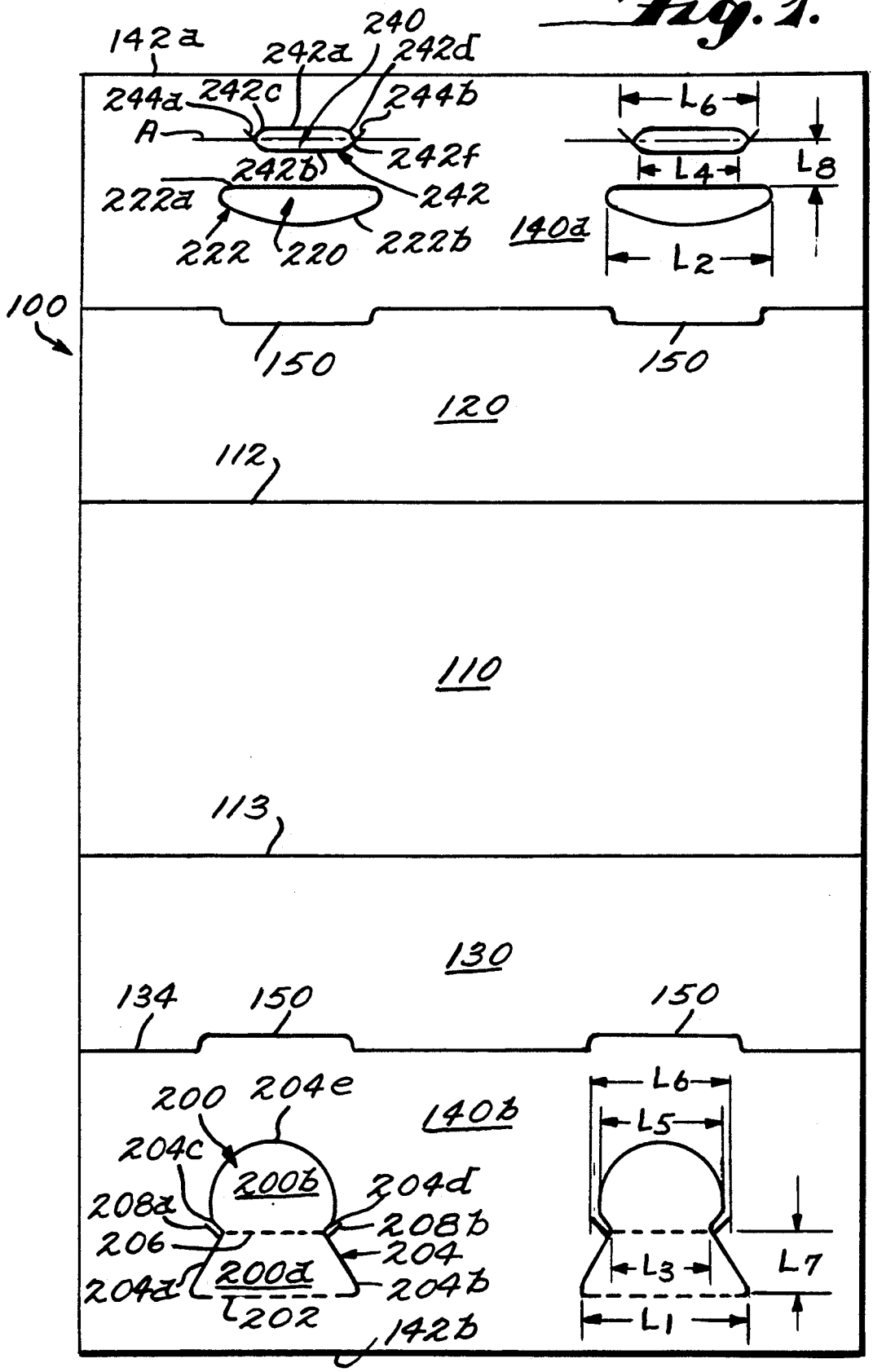

142a
262a
260
262c
262b
242g
240
242h
244a
244b
242e
242f
242l
242j
242
222a
222
220
222b
L10
L6
L4
L8
L2
100
150
150
112
110
113
130
150
134
150
L6
L5
200
204f
204e
204g
200b
204h
208a
208b
200a
206
204a
204b
202
144
L9
L3
L7
L1
142b

PACK MADE FROM BOARD

DESCRIPTION

The invention relates to a pack made from board or a similar material for packaging one or more objects, with a blank that has a top panel, to which two side panels are hinged, and a base panel consisting of two sections, one of which has tabs, while the other one has slot-like openings provided to accommodate these tabs.

The purpose of the invention is to create a pack of the kind outlined above, with which the two base panel sections are locked together securely.

In the solution to this problem proposed by the invention, the tabs die-cut from one base panel section are hinged to this base panel section by a folding line facing the free outside edge of the base panel section, the tab is divided up into two sections by a further folding line that runs parallel to the first folding line and the tab has projections with which it can lock in the openings.

The erected pack is closed by inserting the tab into the first opening from below, the area from which the tab is die-cut forming a hole. The tab itself is then folded and its free section is tucked through the second opening and the hole that has been created, where it locks in position.

In a further advantageous feature of the invention, the two folding lines of the tab run parallel to the free outside edge of the base panel section.

It has also proved to be very advantageous if in accordance with the invention the section of the tab between the two folding lines has the shape of a trapezoid and tapers from the outer folding line to the inner folding line.

In a further advantageous feature of the invention the length of the first folding line is smaller or the same as the length of an essentially straight edge of the opening in the other base panel section.

In a further advantageous feature of the invention, the outline of the second section of the tab is formed by two straight sections and one convex circular section, the two straight sections starting and diverging from the ends of the second folding line and being joined by the convex circular section.

When the tab is die-cut from the blank in accordance with the invention, a hole is formed from which two cuts extend laterally, while two cuts also extend from the second opening of the other base panel section. The purpose of these four cuts is to allow the second section of the tab to pass through.

It is particularly effective here if in accordance with the invention the cuts form an angle with the second folding line that divides up the tab.

This makes sure that the tab cannot go back through the openings again unintentionally once it has been tucked in.

It is particularly advantageous if in accordance with the invention the length of the second opening corresponds approximately to the length of the second folding line.

This guarantees that the tab fits exactly in this opening and does not slip out again after it has been inserted.

In a further advantageous feature of the invention, the distance between the essentially straight outer edge of the first opening and the longest section of the second opening is approximately the same as the distance between the two folding lines of the tab.

In a further advantageous feature of the invention, the second opening narrows towards its two ends.

This helps to hold the tab even more securely when it has been inserted.

It is also very advantageous if in accordance with the invention at least one projection is provided on the outer edge of the base panel section opposite the tab and engages one edge of the opening created by the die-cut tab once the pack has been erected.

In a further advantageous feature of the invention, the distance between the outer edge and the facing edge of the first opening corresponds approximately to the total length of the tab.

In order to make it easier for the projection to engage effectively, the invention proposes that the edge of the tab opposite the hinge folding line is straight and runs parallel to the folding line.

It can also be provided in accordance with the invention that the tab is provided with two hook-like projections that face outwards, the distance of which from the folding line that divides up the tab corresponds approximately to twice the thickness of the blank material.

Several embodiments of the invention are illustrated in the drawings.

Figure 2:
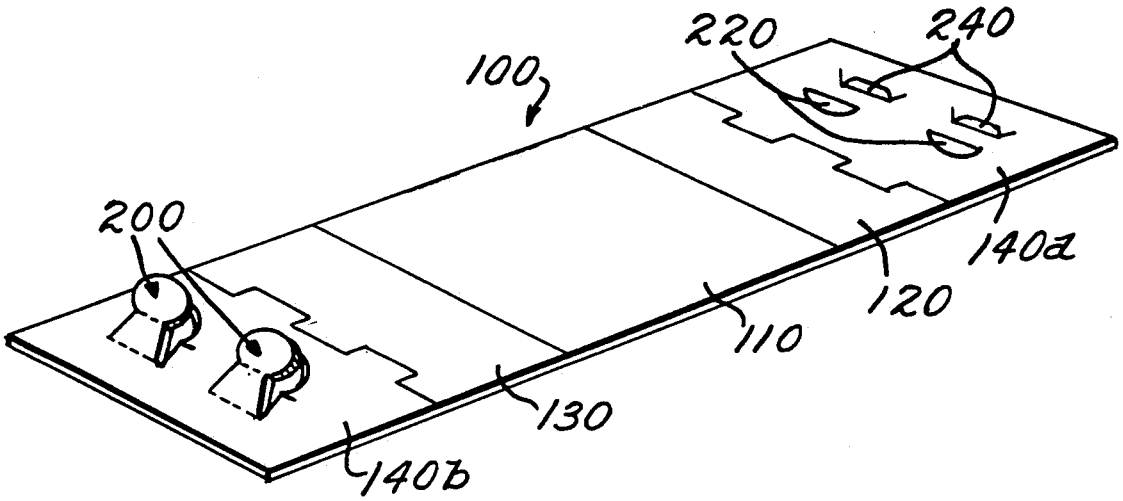
Figure 3:
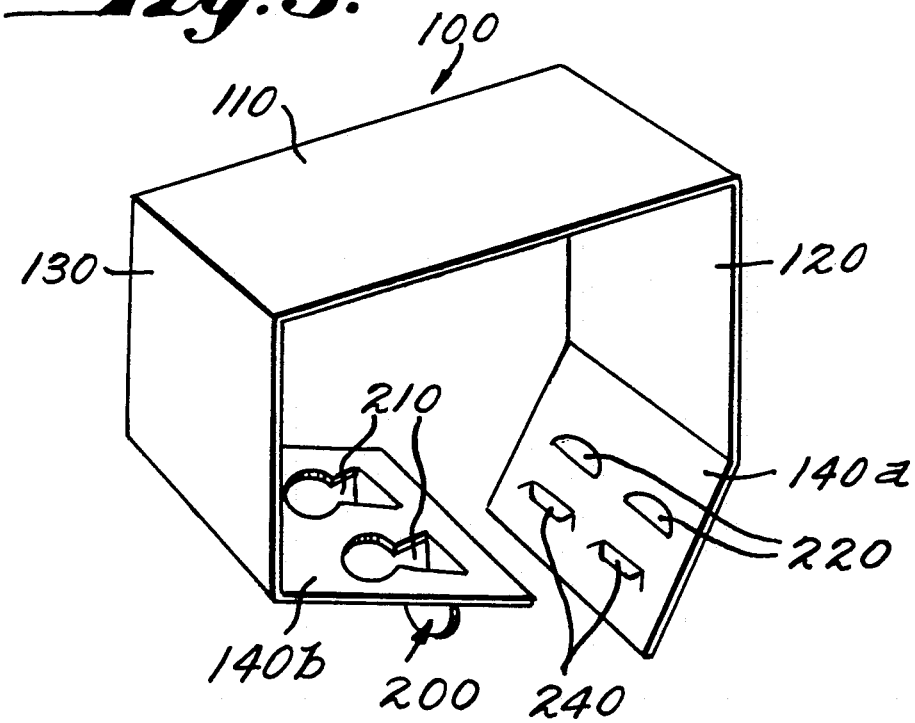
Figure 4A:
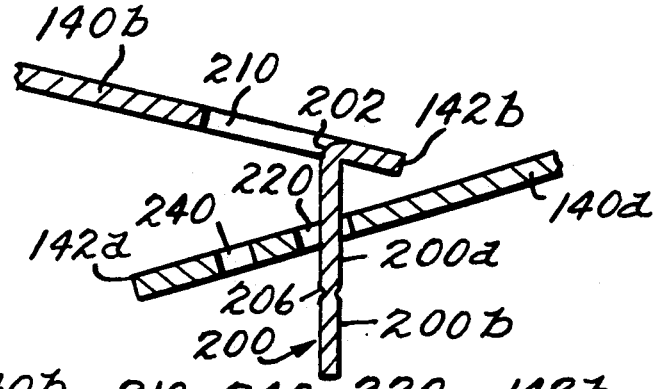
Figure 5:
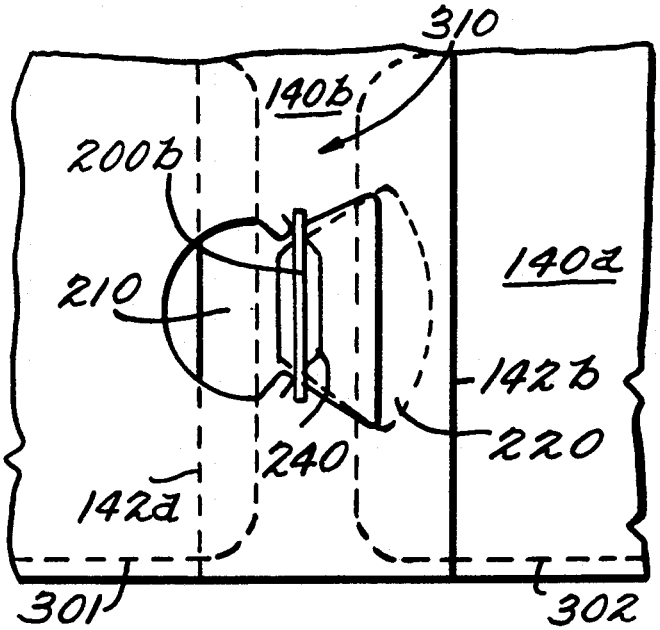
Figure 6:
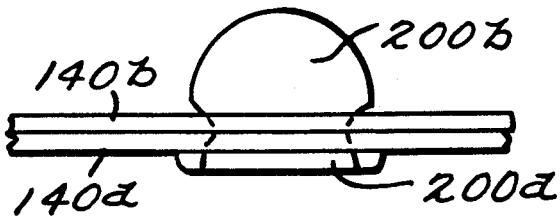
Figure 8A:
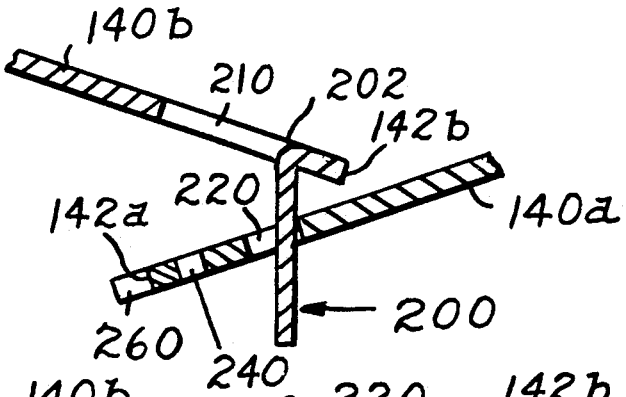
Figure 8B:
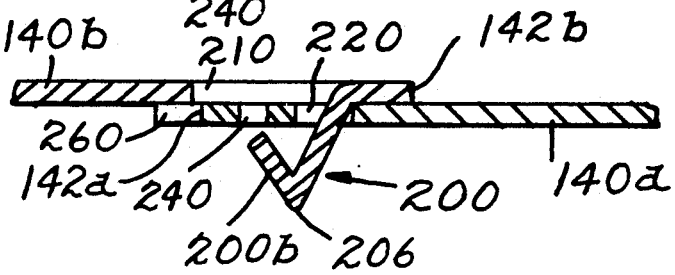
Figure 8C:
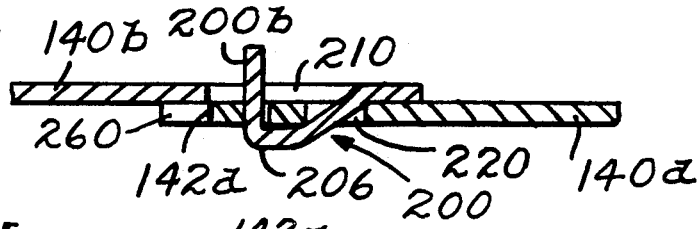
Figure 8D:
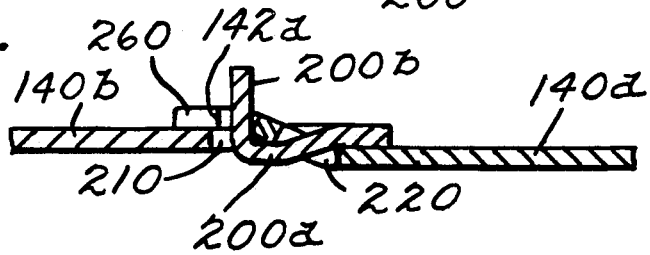
Figure 9:
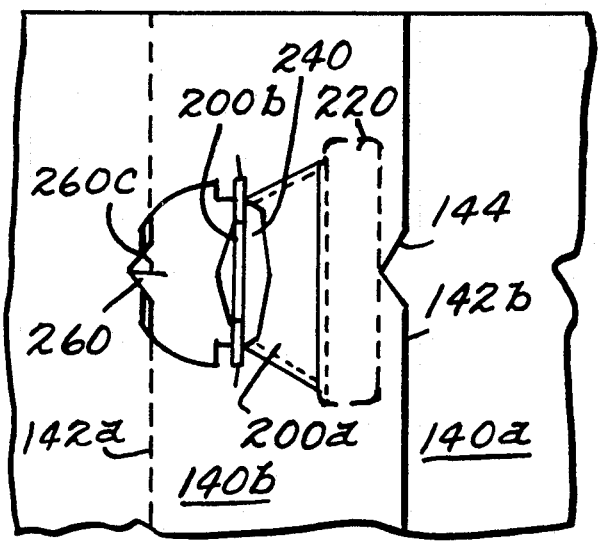
Figure 7:
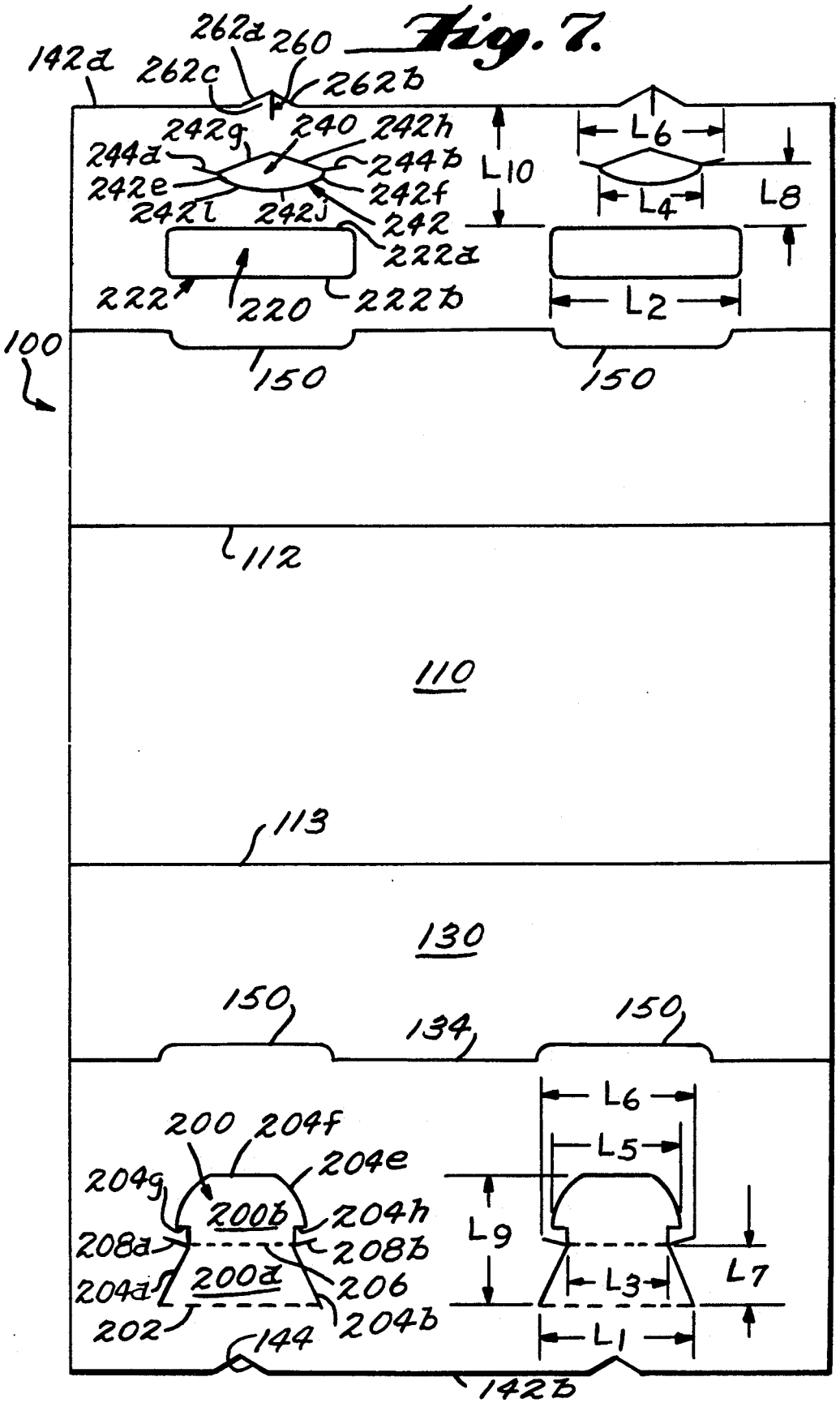

FIG. 1 shows a flat board blank for the production of a pack, with tabs and openings for the mutual locking of the base panel sections, FIG. 2 shows the blank illustrated in FIG. 1 with tabs that have been folded upwards to some extent, FIG. 3 shows the blank once it has been folded more completely, FIG. 4*abc* are cross-sections showing the procedure for locking the two base panel sections, FIG. 5 is a top view of the locked base, FIG. 6 is a view of part of the locked base, FIG. 7 shows a flat board blank designed somewhat differently from the blank illustrated in FIG. 1, FIG. 8 shows stages in the procedure for locking the pack produced from the blank illustrated in FIG. 7 and FIG. 9 shows the locked base of the pack.

FIGS. 1–3 show a board blank 100, which has a top panel 110 to which side panels 120 and 130 are hinged along two folding lines 112 and 113. A base panel section 140*a* is hinged to the side panel 120 along a further folding line 124 and a second base panel section 140*b* is hinged to the side panel 130 along a folding line 134. Both the folding lines 124 and 134 are interrupted by U-shaped cut lines 150, which cause openings to form when the blank is erected. The lower edges of the objects being packaged—which are not illustrated in the figures —engage these openings and are thus held securely.

Two tabs 200, which consist of two sections 200*a* and 200*b*, are hinged to the base panel section 140*b* along a folding line 202 and are divided up by a folding line 206, are die-cut from the base panel section 140*b*. The section 200*a* of the tab hinged directly to the base panel section has the shape of a trapezoid and tapers from the hinge folding line 202 to the division folding line 206. Two straight sections 204*c* and 204*d*, which extend outwards and lead to a convex section 204*e*, are provided next to this section. Two cuts 208*a* and 208*b* extend away from the tab from the cut line 204 forming the tab 200, in the area of the folding line 206.

Two larger openings 220 and two smaller openings 240, through which the tabs are inserted and locked, are provided behind each other in the other base panel section 140*a*. The opening 220 is defined by a cut line 222, which has an essentially straight edge 222a and a curved edge 222b. The opening 240 or rather its cut edge 242, on the other hand, has two straight sections 242a and 242b, which are limited by two slanting sections 242c, 242d and 242e, 242f and thus end in a point. Two cuts 244a and 244b, which allow the tab 200 to pass through, are provided at these points. The length of the opening 240 marked L4 corresponds approximately to the length L3 of the second folding line 206 of the tab 200. Insertion of the tab is only made possible by the length L6 formed by the cuts 244a and 244b, which is somewhat larger than the width L5 of the top tab section 200b. The opening 220, on the other hand, has a length L2, which is at least the same as the length L1 of the tab along its hinged folding line 202, as a result of which this tab section is easy to insert in the opening. The distance L8 between the longest middle section A of the opening 240 and the straight edge 222a of the opening 220 corresponds to the distance L7 between the two folding lines 202 and 206, so that the tab can be inserted smoothly, as is shown in FIG. 4a,b,c.

As can be seen in FIGS. 2 and 3, the tabs 200 are pressed outwards first of all when the blank is erected into a pack. Then the blank is folded along its folding lines and wrapped around the objects (not illustrated here), so that the base panel section 140b is located on the inside and the base panel section 140a is located on the outside.

Figure 4B:
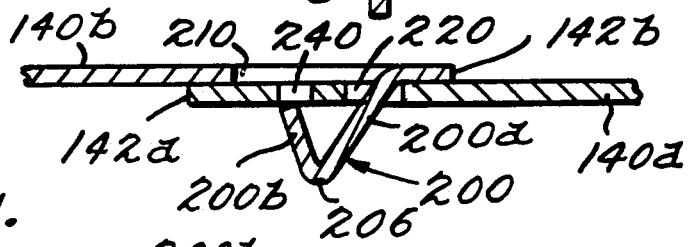
Figure 4C:
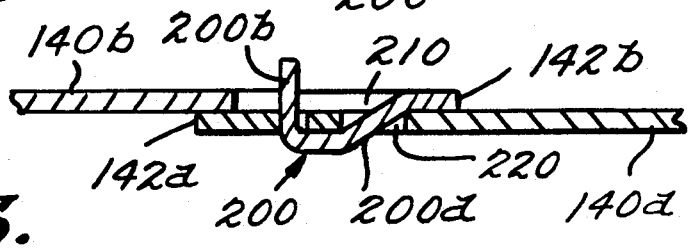

As FIG. 4a shows, the tab 200 is then tucked through the opening 220 from inside and the two base panel sections 140a and *b* are placed flat on top of each other. As is shown in FIG. 4b, the tab itself is then folded along the folding line 206 and the free section 200b of the tab is tucked inwards through the openings 240 and 210 and then projects vertically inwards, as can be seen in FIG. 4c.

FIGS. 5 and 6 show this final situation from two different perspectives.

In the embodiment illustrated in FIG. 7 the tabs and the openings through which the tabs are tucked differ only slightly from those of the embodiment described above. The edge 204f of the tab opposite the hinge folding line 202 is flat, in order to be able to accommodate a projection 260 which is provided on the opposite edge 142a of the blank. This projection has two slanting edges 262a and 262b, which give it its pointed shape. It is in addition divided up into two sections by a cut 262c, which makes it easier to press the projection into position. In this embodiment it is important that the distance L10 from the outer edge 222a of the opening 220 to the outer edge 142a of the blank corresponds to the total length L9 of the tab.

The initial stages in the procedure for inserting the tab are the same as in the previous example, as can be seen in FIG. 8a,b and *c*. After this, as FIG. 8d shows, the projection 260 is pressed inwards through the opening 210 and then rests on the inside of the base panel section 140b. This is shown clearly in FIG. 9.

I claim:

1. A pack made from a board material for packaging one or more objects, said pack comprising a blank having a first panel which will serve as a top panel in use, said first panel having opposite edges and a side panel hingedly connected to each said opposite edge, said side panels each having an edge spaced from said hinged connection to said first panel, a base panel comprising two portions, each of said portions having an edge hingedly connected to said spaced edge of one of said side panels, said two portions having interengaging means for securing said two portions together to define said base panel, said interengaging means comprising on one of said portions a pair of tabs formed by die-cutting into said one portion with said tabs being hingedly connected to said one portion by respective first folding lines, each said portion having a free edge with said first folding lines extending parallel to said free edge of said respective portion of said base panel, each said tab having a second folding line which extends parallel to said first folding line with said second folding line defining a section of each tab having projections extending from said section, said tab having a body portion disposed between said folding lines thereof with said body portion having the shape of a trapezoid which tapers from said first folding line to said second folding line so that the length of the second folding line is less than the length of said first folding line, the free end of the tab having a convex circular section having opposite ends connected to said second fold line each by straight edges with said straight edges extending divergingly from said second folding line, said other portion of said base panel including openings each for receiving a said tab.

2. The invention as claimed in claim 1, said portion of said base panel from which said tabs are die-cut includes cuts formed therein to extend laterally from the die-cut for said tabs.

3. The invention as claimed in claim 2, wherein said cuts form an angle with said second folding line of each associated tab.

4. The invention as claimed in claim 1, wherein said other portion of said base panel includes two pairs of openings with each pair comprising a first and second opening, a first set of each pair lying closer to the free edge of said other portion of the base panel and having a length corresponding approximately to the length of said second folding line of each said tab.

5. The invention as claimed in claim 4, wherein said second set of openings of said pair in said other portion of said base panel has a straight outer edge and said second set of openings having a maximum dimension approximately equal to the distance between said first and second folding lines of the tab.

6. The invention as claimed in claim 5, wherein said second set of openings has a maximum transverse dimension approximately intermediate the opposite ends of said second opening, the said opening narrowing towards said opposite ends.

7. The invention as claimed in claim 1 wherein said other portion of said base panel has a free edge and at least one projection provided on said free edge and positioned there along so as to overlie a portion of the die-cut opening from which a corresponding tab is formed in the one portion of said base panel when said pack is assembled.

8. The invention as claimed in claim 7, wherein the transverse distance between said free edge of said other portion of said base panel and the adjacent edge of said second set of openings corresponds approximately to the length of a said corresponding tab.

9. The invention as claimed in claim 1, wherein each said tab has an edge opposite the second folding line which is straight and runs parallel to said second folding line.

10. The invention as claimed in claim 9, wherein said projections are hook-like in form and extend outwardly from the body of said tab, said hook-like projections being spaced from said second folding line a distance equal approximately to twice the thickness of the blank.

* * * * *